US007775919B2

(12) United States Patent
Oswald et al.

(10) Patent No.: US 7,775,919 B2
(45) Date of Patent: Aug. 17, 2010

(54) CAMOUFLAGE SYSTEM

(75) Inventors: Christopher M. Oswald, Ogden, UT (US); Gary Cornum, Millcreek, UT (US); Robert G. Corsetti, Farmington, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 486 days.

(21) Appl. No.: 11/875,442

(22) Filed: Oct. 19, 2007

(65) Prior Publication Data

US 2009/0105018 A1 Apr. 23, 2009

(51) Int. Cl.
*F42B 6/04* (2006.01)
*B41M 3/00* (2006.01)

(52) U.S. Cl. ..... 473/578; 428/919

(58) Field of Classification Search ..... 2/900; 283/72; 428/17, 195.1, 919; 473/578
See application file for complete search history.

(56) References Cited

U.S. PATENT DOCUMENTS 5,924,131 A 7/1999 Wilkinson
5,985,381 A * 11/1999 Conner ..... 428/15
6,127,022 A * 10/2000 Pretorius ..... 428/195.1
6,682,879 B2 1/2004 Conk
6,805,957 B1 10/2004 Santos et al.
6,866,599 B2 * 3/2005 Eastman, II ..... 473/578
2005/0005339 A1 1/2005 Johnson
2005/0053732 A1 * 3/2005 Tilby ..... 428/17

FOREIGN PATENT DOCUMENTS

GB 2434431 7/2007

OTHER PUBLICATIONS

Internet Article, HyperStealth Biotechnology Corp. (www.hyperstealth.com), Digital Camouflage History, date unknown.

* cited by examiner

*Primary Examiner*—John Ricci
(74) *Attorney, Agent, or Firm*—Holland & Hart

(57) ABSTRACT

A camouflage system, comprising an article having a surface and a camouflage pattern covering a portion of the surface, is disclosed. The camouflage pattern may comprise a geometric shape section and an image section. The geometric shape section may comprise a plurality of geometric shape elements and a geometric shape section boundary. The image section may comprise an image element comprising a graphic image and an image section boundary. The image element may comprise a graphic image of a portion of a natural scene. An archery arrow system, comprising an archery arrow and a camouflage pattern on a portion of the archery arrow, is also disclosed. The camouflage pattern on the portion of the archery arrow may comprise a geometric shape section and an image section.

20 Claims, 8 Drawing Sheets

CAMOUFLAGE SYSTEM

FIELD OF THE INVENTION

The instant disclosure relates generally to the field of camouflage patterns for use in various applications, including, for example, military, hunting, and various sporting activities.

BACKGROUND

Camouflage systems are typically designed to camouflage people and objects in various outdoor environments. Camouflage systems are often used by hunters and various other outdoor recreational enthusiasts, including paint ball players and bird watchers. Camouflage systems are also used by military personnel for training and combat situations. Camouflage systems are designed to protect individuals and objects from being detected by other people and animals.

Camouflage systems typically work by disguising a person or a piece of equipment so that they blend in with the outdoor surroundings. For example, a hunter in a forest may use a camouflage system that enables the hunter to at least partially blend-in visually with the trees and other foliage in the forest, including the undergrowth and leaves covering the forest floor. In contrast, a soldier operating in a desert environment may use a camouflage system that enables the soldier to at least partially blend in with sand and rock formations present in the desert.

Camouflage systems may include camouflage clothing having a functional camouflage pattern that is visible on the exterior of the clothing. Additionally, camouflage systems may include various objects that have a functional camouflage pattern that is visible on exterior portions. For example, equipment used by individuals, such as military, sportsmen, and other sporting enthusiasts, may include various camouflage patterns. Additionally, various shelters and enclosures often include a camouflage pattern on exterior portions.

SUMMARY

According to at least one embodiment, a camouflage system may comprise an article having a surface and a camouflage pattern. The camouflage pattern may comprise a geometric shape section comprising a plurality of geometric shape elements and a geometric shape section boundary. The camouflage pattern may also comprise an image section, the image section comprising an image element comprising a graphic image and an image section boundary. Additionally, the camouflage pattern may cover a portion of the surface of the article.

In certain embodiments, the image element may comprise a graphic image of a portion of a natural scene. The geometric shape section may further comprise a first geometric shape element comprising a first color and a second geometric shape element comprising a second color. The geometric shape section may also comprise a geometric shape element comprising more than one color.

In additional embodiments, the geometric shape section may comprise a plurality of substantially congruent geometric shape elements. In various embodiments, the geometric shape section may comprise a plurality of substantially incongruent geometric shape elements. In at least one embodiment, a portion of the geometric shape section boundary may substantially coincide with a portion of the image section boundary.

In certain embodiments, the geometric shape section may comprise a geometric shape element having a geometric shape element perimeter, and a portion of the geometric shape section boundary may substantially coincide with a portion of the geometric shape element perimeter. Additionally, the image section boundary may intersect the geometric shape element perimeter. In at least one embodiment, the image element may comprise an image element perimeter, and a portion of the image section boundary may substantially coincide with a portion of the image element perimeter. Also, the geometric shape section boundary may intersect the image element perimeter.

In additional embodiments, the geometric shape section may comprise a color substantially identical to a color in the image element. In certain embodiments, a portion of the geometric shape section and a portion of the image section may occupy the same portion of the camouflage pattern. In at least one embodiment, a portion of the image section may overlap a portion of the geometric shape section. In certain embodiments, a portion of the geometric shape section may overlap a portion of the image section. Additionally, a portion of the geometric shape section and a portion of the image section may overlap each other. In various embodiments, the geometric shape section may occupy a portion of the camouflage pattern that is distinct from the image section. Additionally, the image of the portion of the natural scene may comprise an image of a leaf.

In at least one embodiment, an archery arrow system may comprise an archery arrow and a camouflage pattern on a portion of the archery arrow. The camouflage pattern may comprise a geometric shape section comprising a plurality of geometric shape elements and a geometric shape section boundary. The camouflage pattern may also comprise an image section comprising an image element comprising a graphic image and an image section boundary.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION OF EXEMPLARY EMBODIMENTS

Figure 1:
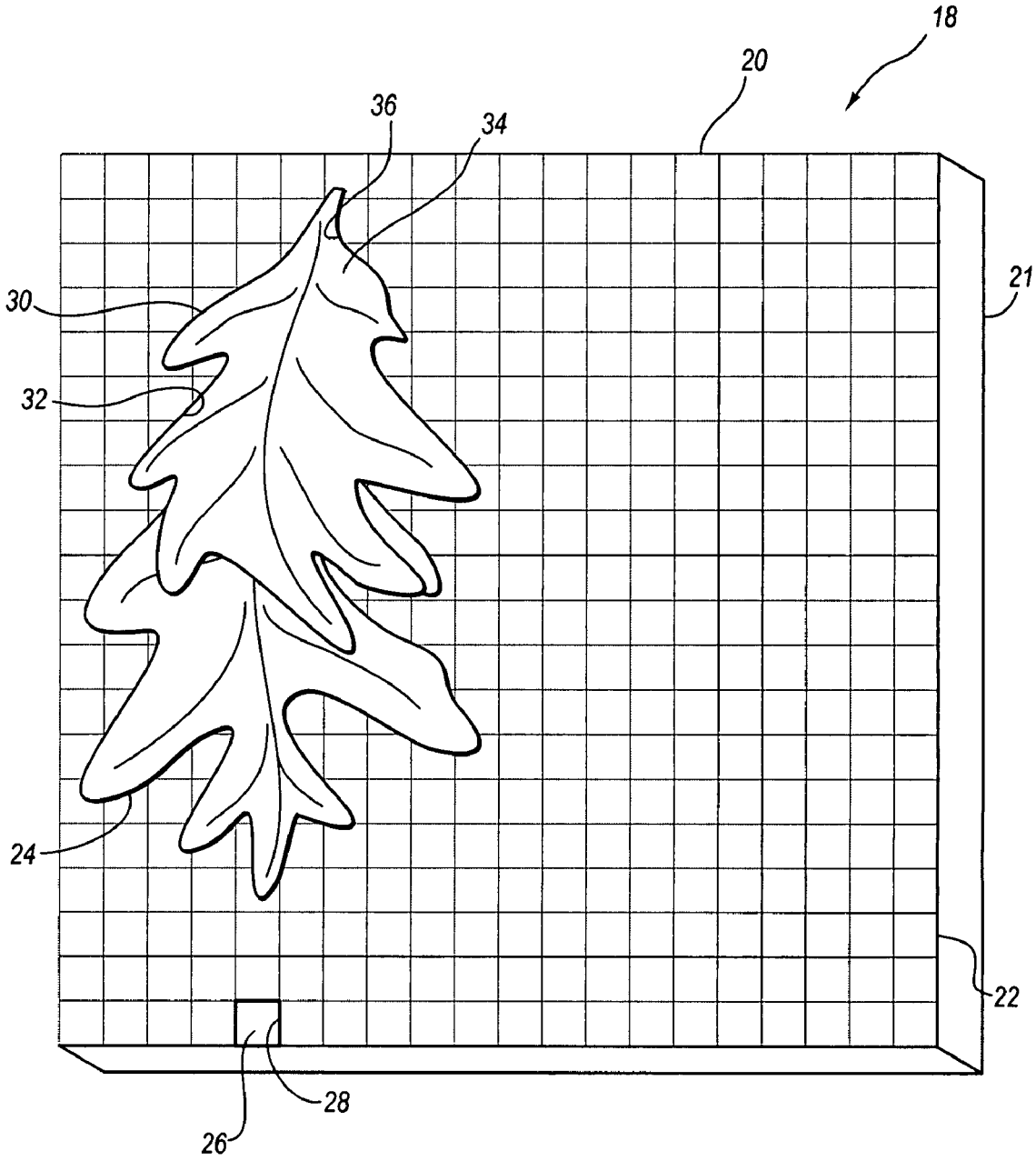
FIG. 1 is a perspective view of an exemplary camouflage system according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

Unless otherwise noted, the terms "a" or "an," as used in the specification and claims, are to be construed as meaning "at least one of." For ease of use, the words "including" and "having," as used in the specification and claims, are interchangeable with and have the same meaning as the word "comprising." In addition, the term "coincide," "coincides," or "coinciding" may be used broadly to mean to occupy the same relative position or point, or the same area in space. Also, the term "congruent" may be used broadly to mean coinciding when superimposed, and may refer to geometric shapes or figures that have the same size and/or shape, or substantially the same size and/or shape.

FIG. 1 is an illustration of an exemplary camouflage system 18 according to at least one embodiment. As illustrated in this figure, camouflage system 18 may comprise an article 21 and a camouflage pattern 20. Camouflage pattern 20 may comprise one or more geometric shape sections 22 and one or more image sections 30. Geometric shape section 22 may comprise a plurality of geometric shape elements 26 and a geometric shape section boundary 24. Each of geometric shape elements 26 may have a geometric shape element perimeter 28. Image section 30 may comprise an image element 34 and an image section boundary 32. Image element 34 may comprise an image element perimeter 36.

Geometric shape section 22 may represent a portion of camouflage pattern 20 comprising a plurality of geometric shape elements 26. Geometric shape section boundary 24 may comprise a border or edge portion of geometric shape section 22, as illustrated in FIG. 1. Additionally, geometric shape section boundary 24 may comprise an interior and/or an exterior boundary of geometric shape section 22. In various embodiments, geometric shape section boundary 24 may be adjacent to one or more geometric shape elements 26. In at least on embodiment, geometric shape elements 26 may be directly adjacent to other geometric shape elements 26. In additional embodiments, geometric shape elements 26 may be separated from other geometric shape elements 26. Additionally, geometric shape element perimeters 28 may contact other geometric shape element perimeters 28. Geometric shape element perimeters 28 may also be separated from other geometric shape element perimeters 28.

Geometric shape element 26 may represent any suitable geometric shape, or portion of a geometric shape, having a plurality of sides and/or a curved shape. Geometric shape element 26 may comprise a plurality of picture elements (i.e., pixels). The pixels may be of any size without being distinct and visibly separate geometric shapes. Alternatively, the pixels may be visibly distinct geometric shape elements. The pixels may be of any size or scale to match the so-called product pallet. Further, the pixels may be of any shape, including without limitation, one of the geometric shape elements specified below. The intensity of each pixel may also be variable. Each pixel may have three or four dimensions of variability, for example without limitation red, green, and blue, or cyan, magenta, yellow, and black, or any other combination of colors according to the desired camouflage pattern.

Examples of geometric shape element 26 include, without limitation, a triangle, a quadrilateral, a square, a rectangle, a rhomboid, a trapezoid, a pentagon, a hexagon, a heptagon, an octagon, an enneagon, a decagon, or any other suitable polygon having three or more sides. Additionally, geometric shape element 26, may include any type of polygon, or portion of a polygon, including, for example, a regular polygon, a convex polygon, a concave polygon, a cyclic polygon, a bicentric polygon, or any other suitable type of polygon. Geometric shape element 26 may also comprise a curved or rounded shape, including, for example, a circle, a semicircle, an oval, an ellipse, or any other suitable curved shape.

Image section 30 may represent a portion of camouflage pattern 20 comprising at least one image element 34. Image section boundary 32 may comprise a border or edge portion of image section 30, as illustrated in FIG. 1. Additionally, image section boundary 32 may comprise an interior and/or an exterior boundary of shape section 30. In various embodiments, boundary 32 may be adjacent to one or more image elements 34.

In at least one embodiment, image section 30 may comprise at least one image element 34 comprising a graphic image of a portion of a natural scene. Image element 34 may comprise any suitable graphic image of a portion of natural scene, including, for example, a graphic image of a portion of a forest scene, a meadow scene, a desert scene, or any other suitable outdoor scene. In various embodiments, image element 34 may comprise a graphically realistic, or photo-realistic, image of the portion of the scene. In an exemplary embodiment, image element 34 may comprise an image of a distinct element in a natural scene, such as, for example, a leaf from a tree or from a forest floor, as shown in FIG. 1. Image element 34 may be produced in image section 30 so that it looks like an actual image element in a natural outdoor environment when viewed by an individual or an animal.

Geometric shape section 22 and image section 30 may comprise any suitable color or combinations of colors. In various embodiments, geometric shape section 22 and/or image section 30 may comprise multiple colors. Colors used in geometric shape section 22 and image section 30 may include colors having any suitable hue, lightness, and/or saturation. In at least one embodiment, the colors in geometric shape section 22 and/or image section 30 may include colors or combinations of colors found in natural environments, such as, for example, outdoor environments in which camouflage system 18 may be used. The colors may be selected using any method or system, including, for example, the PANTONE MATCHING SYSTEMS® (Pantone, Inc., Carlstadt, N.J.), or any other suitable color hue identification system.

Camouflage system 18 comprising camouflage pattern 20, which includes geometric shape section 22 and image section 30, may appear to a person or an animal to be a three-dimensional scene. In at least one embodiment, geometric shape section 22 and image section 30 may appear to be on different visual planes. Camouflage system 18 comprising camouflage pattern 20 may effectively obscure a person or an object with the three-dimensional effect exhibited by the combination of geometric shape section 22 and image section 30. A person or any other object that includes camouflage pattern 20 on the visible exterior of the object may be visually obscured to a viewer by camouflage pattern 20, which may disrupt the lines and contours of the object with a three-dimensional effect created by the combination of geometric shape section 22 and image section 30. In comparison to conventional camouflage systems, the use of camouflage system 18, which combines the use of both geometric shape section 22 and image section 30, may enhance the three-dimensional visual effect exhibited by camouflage system 18. In various embodiments, the combination of geometric shape section 22 and image section 30 may increase the visual depth of camouflage pattern 20 in comparison with conventional camouflage patterns.

In at least one embodiment, the use of camouflage system 18 comprising both geometric shape section 22 and image section 30 may enhance the ability of camouflage system 18 to obscure an individual or object when viewed from a relatively close distance, a relatively far distance, and/or any distance intermediate distance. The combination of colors and graphic images used in geometric shape section 22 and image section 30 of camouflage system 18 may also enhance the ability of an individual or an object to visually blend-in with a particular environment. In additional embodiments, the combination of geometric shape section 22 and image section 30 may enhance the aesthetic qualities of an article of clothing and/or a piece of equipment utilizing camouflage system 18, in comparison with conventional camouflage systems.

Figure 2A:
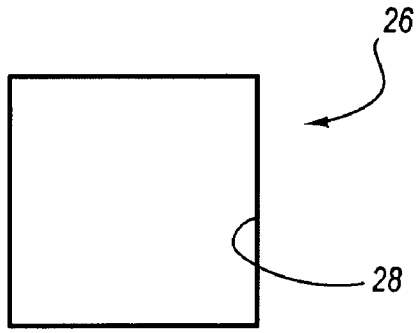
FIG. 2A is an illustration of an exemplary geometric shape element of a camouflage pattern according to at least one embodiment.
Figure 2B:
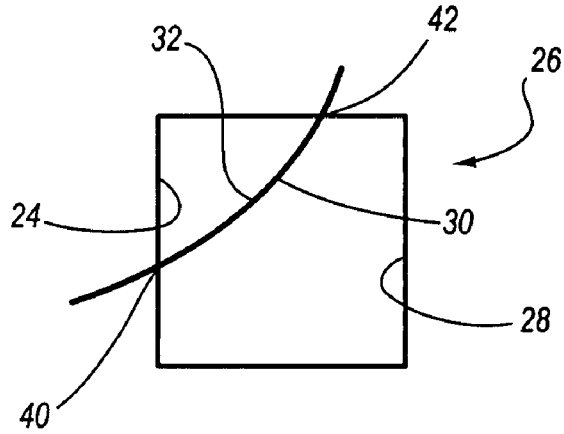
FIG. 2B is an illustration of an exemplary geometric shape element of a camouflage pattern according to an additional embodiment.
Figure 2C:
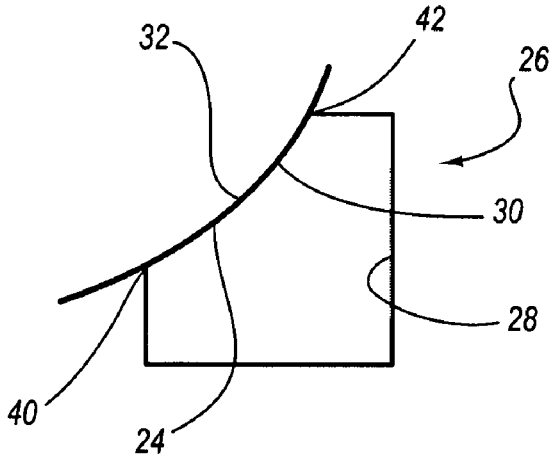
FIG. 2C is an illustration of an exemplary geometric shape element of a camouflage pattern according to an additional embodiment.

FIGS. 2A-2C illustrate various exemplary embodiments of geometric shape element 26. As illustrated in these figures, geometric shape element 26 may have a geometric shape element perimeter 28. Geometric shape element perimeter 28 may comprise an outer edge or border defining and/or surrounding at least a portion of geometric shape element 26. A portion of geometric shape section boundary 24 may substantially coincide with a portion of geometric shape element perimeter 28.

Geometric shape element 26 may comprise any color or combination of colors. In various embodiments, geometric shape element 26 may comprise, for example, colors chosen to match or approximate colors found in a particular outdoor setting, such as colors commonly found in a forest, desert, rock formation, grassland, wetland, or any other outdoor environment. Geometric shape element 26 may comprise a single solid color, or alternatively, may comprise multiple colors. In at least one embodiment, geometric shape element 26 may comprise different colors in different portions of an area surrounded by geometric shape element perimeter 28.

As illustrated in FIGS. 2B and 2C, a portion of geometric shape section boundary 24 may substantially coincide with a portion of geometric shape element perimeter 28. In an additional embodiment, image section boundary 32 may intersect geometric shape element perimeter 28 at one or more points. As illustrated in FIG. 2B, image section boundary 32 may intersect geometric shape element perimeter 28 at a first intersection point 40 and a second intersection point 42. Image section boundary 32 may also likewise intersect geometric shape section boundary 24 at first intersection point 40 and second intersection point 42. In the embodiment shown in FIG. 2B, a portion of geometric shape element 26 may overlap a portion of image section 30, the overlapping region being defined by an area between geometric shape section boundary 24 and image section boundary 32, and between first intersection point 40 and second intersection point 42.

In an additional embodiment, as illustrated in FIG. 2C, image section boundary 32 may intersect geometric shape section boundary 24 and geometric shape element perimeter 28 at first intersection point 40 and second intersection point 42. In this embodiment, geometric shape section boundary 24 may substantially coincide with image section boundary 32 between first intersection point 40 and second intersection point 42. In this embodiment, geometric shape element 26 may not overlap image section 30 between first intersection point 40 and second intersection point 42. Rather, image section 30 may be adjacent to geometric shape element 26 between first intersection point 40 and second intersection point 42.

Figure 3A:
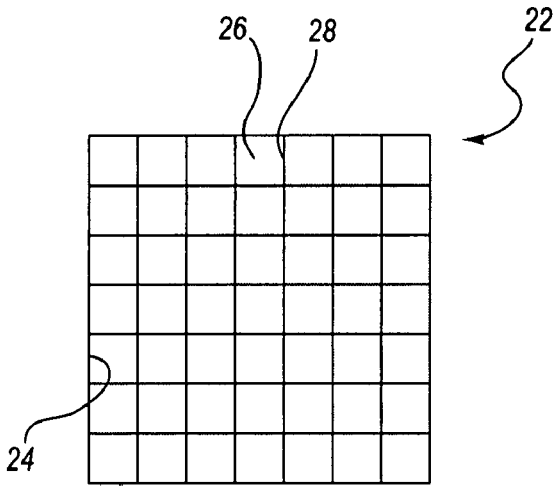
FIG. 3A is an illustration of an exemplary geometric shape section of a camouflage pattern according to at least one embodiment.
Figure 3B:
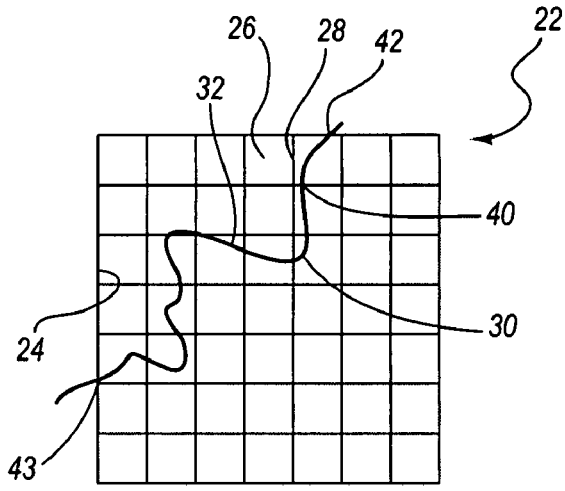
FIG. 3B is an illustration of an exemplary geometric shape section of a camouflage pattern according to an additional embodiment.
Figure 3C:
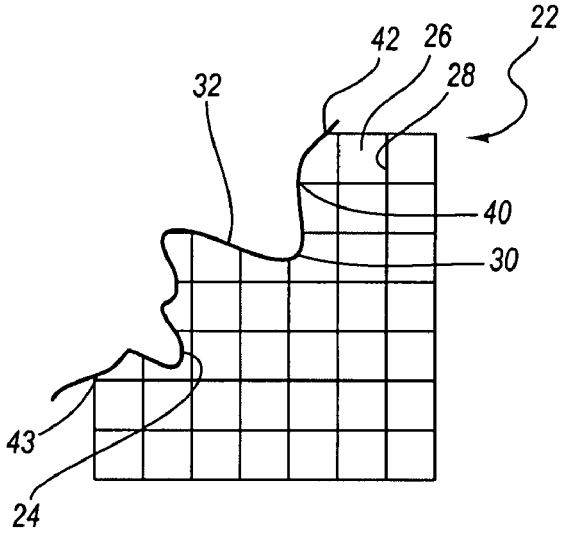
FIG. 3C is an illustration of an exemplary geometric shape section of a camouflage pattern according to an additional embodiment.

FIGS. 3A-3C illustrate various exemplary embodiments of geometric shape section 22. As illustrated in these figures, geometric shape section 22 may comprise a geometric shape section boundary 24 and a plurality of geometric shape elements 26. Each geometric shape element 26 may have a geometric shape element perimeter 28. In at least one embodiment, a portion of geometric shape section boundary 24 may substantially coincide with portions of geometric shape element perimeters 28 from various geometric shape elements 26.

In various embodiments, as illustrated in FIGS. 3B and 3C, image section boundary 32 may intersect geometric shape element perimeters 28 of various geometric shape elements 26. For example, as illustrated in FIG. 3B, image section boundary 32 may intersect a geometric shape element perimeter 28 at a first intersection point 40 and a second intersection point 42. Image section boundary 32 may also likewise intersect geometric shape section boundary 24 at second intersection point 42 and a third intersection point 43. In the embodiment shown in FIG. 3B, a portion of geometric shape section 22, and accordingly, portions of various geometric shape elements 26, may overlap a portion of image section 30, the overlapping regions being defined by an area between geometric shape section boundary 24 and image section boundary 32, and between second intersection point 42 and third intersection point 43.

In an additional embodiment, as illustrated in FIG. 3C, image section boundary 32 may intersect geometric shape section boundary 24 at second intersection point 42 and third intersection point 43. In this embodiment, geometric shape section boundary 24 may substantially coincide with image section boundary 32 between second intersection point 42 and third intersection point 43. Accordingly, image section 30 may not overlap geometric shape section 22 between second intersection point 42 and third intersection point 43. Rather, image section 30 may be adjacent to geometric shape section 22 between second intersection point 42 and third intersection point 43. Image section 30 may also be adjacent to various geometric shape elements 26.

Figure 4A:
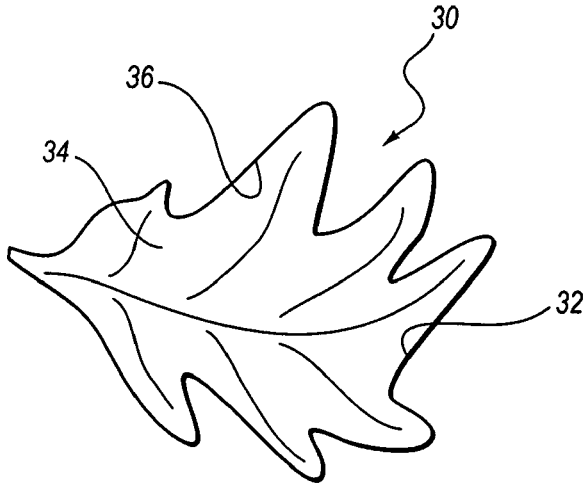
FIG. 4A is an illustration of an exemplary image element of a camouflage pattern according to at least one embodiment.
Figure 4B:
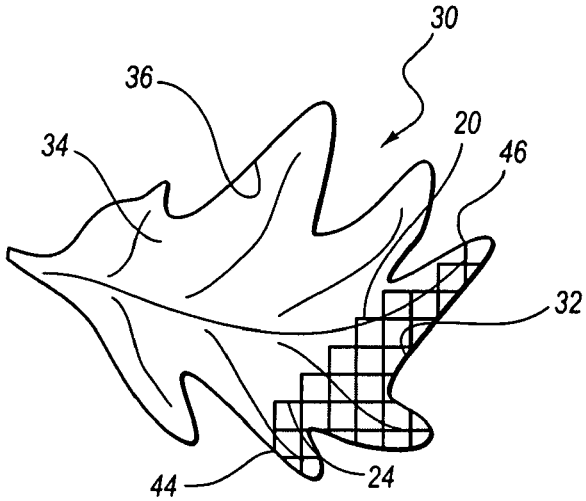
FIG. 4B is an illustration of an exemplary image element of a camouflage pattern according to an additional embodiment.
Figure 4C:
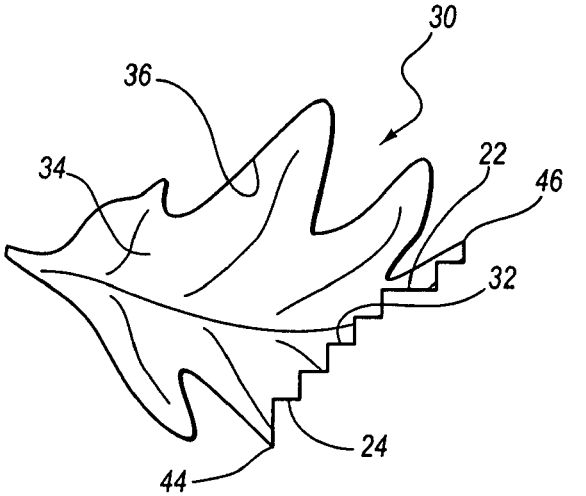
FIG. 4C is an illustration of an exemplary image element of a camouflage pattern according to an additional embodiment.

FIGS. 4A-4C illustrate various exemplary embodiments of image section 30. As illustrated in these figures, image section 30 may comprise an image element 34 and an image section boundary 32. Image element 34 may have an image element perimeter 36. In at least one embodiment, a portion of image section boundary 32 may substantially coincide with a portion of image element perimeter 36.

Image section 30 may comprise any object and any color or combination of colors. In various embodiments, image section 30 may comprise, for example, colors and objects (e.g., rocks, dirt, sand, snow, sky, leaves, branches, sticks, grass blades, shrubs, trees, or any other natural outdoor object) chosen to match or approximate colors and objects found in a particular outdoor setting, such as, for example, colors frequently found in a desert, rock formation, forest, wetland, grassland, snow field, sky, or any other outdoor environment. Image element 34 of image section 30 may comprise a single solid color, or alternatively, may comprise multiple colors. In at least one embodiment, image element 34 may comprise different colors in different portions of an area surrounded by image element perimeter 36.

In various embodiments, at least a portion of image section boundary 32 may substantially coincide with a portion of the image element perimeter 36. In an additional embodiment, as illustrated in FIGS. 4B and 4C, geometric shape section boundary 24 may intersect image section boundary 32, and may likewise intersect image element perimeter 36, at one or more points. As illustrated in FIG. 4B, geometric shape section boundary 24 may intersect image section boundary 32 and image element perimeter 36 at a first intersection point 44 and a second intersection point 46. In this embodiment, a portion of geometric shape section 22 may overlap a portion of image element 34, and may likewise overlap a portion of image section 30, the overlapping region being defined by an area between geometric shape section boundary 24 and image section boundary 32, and between first intersection point 44 and second intersection point 46.

In an additional embodiment, as illustrated in FIG. 4C, geometric shape section boundary 24 may intersect image section boundary 32 at first intersection point 44 and second intersection point 46. In this embodiment, image section boundary 32 may substantially coincide with geometric shape section boundary 24 between first intersection point 44 and second intersection point 46. In this embodiment, neither image section 30 nor image element 34 may overlap geometric shape section 22 between first intersection point 44 and second intersection point 46. Rather, image section 30 and image element 34 may be adjacent to geometric shape section 22 between first intersection point 44 and second intersection point 46.

Figure 5A:
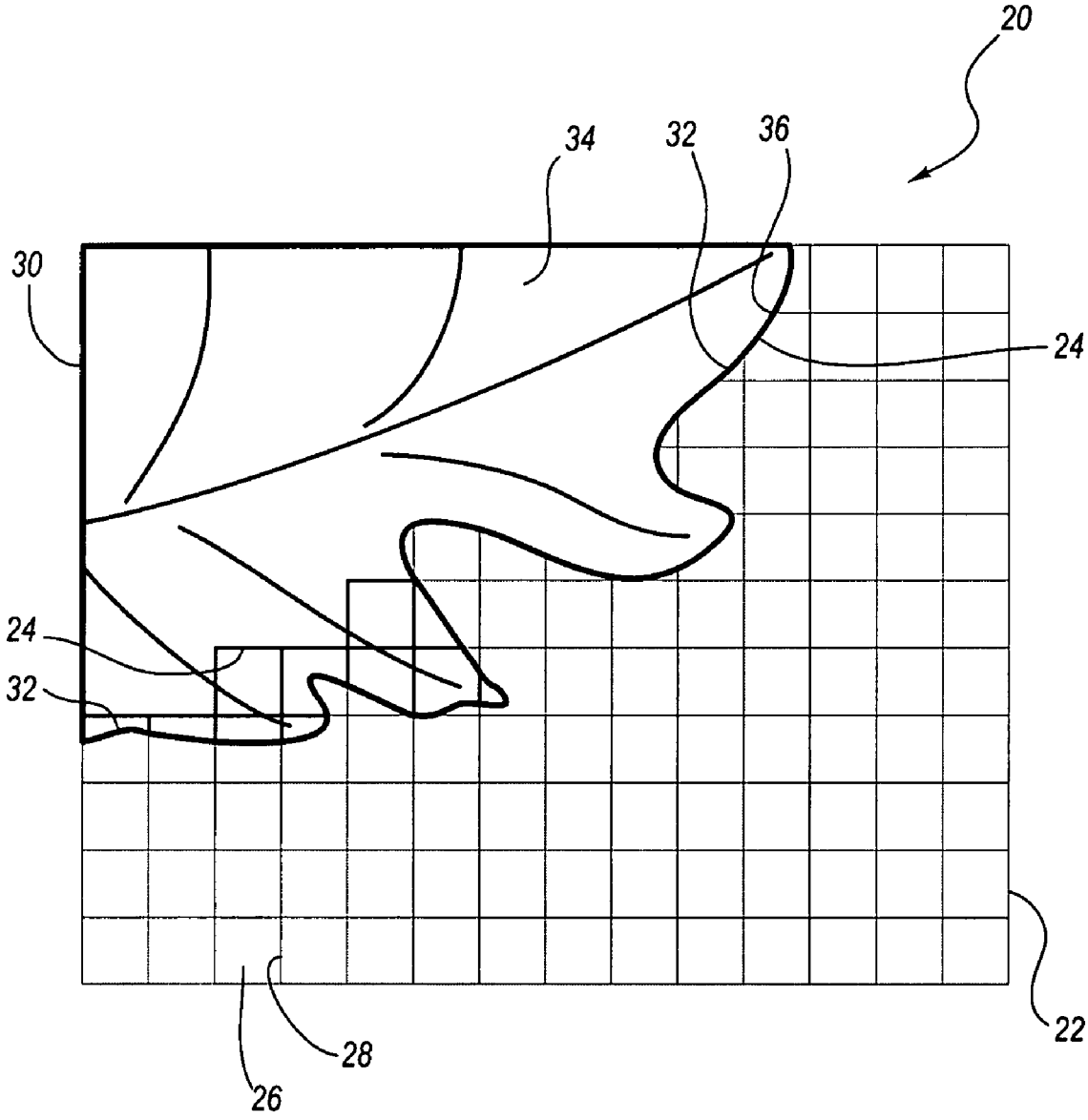
FIG. 5A is an illustration of an exemplary camouflage pattern according to an additional embodiment.
Figure 5B:
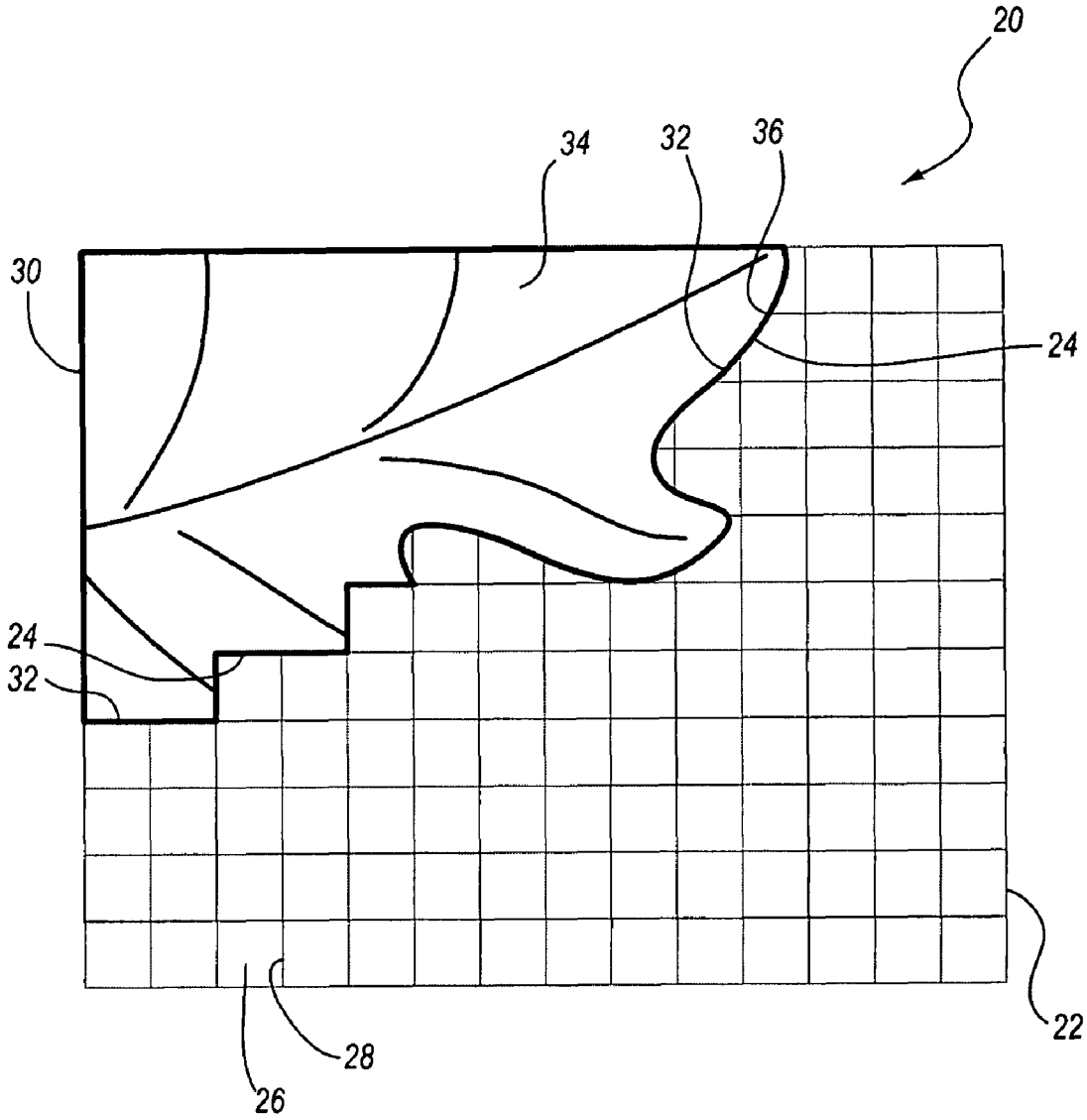
FIG. 5B is an illustration of an exemplary camouflage pattern according to an additional embodiment.

FIGS. 5A and 5B illustrate certain embodiments of exemplary camouflage pattern 20. As illustrated in these figures, geometric shape section 22 may comprise a geometric shape section boundary 24 and a plurality of geometric shape elements 26. Each geometric shape element 26 may have a geometric shape element perimeter 28. In at least one embodiment, a portion of geometric shape section boundary 24 may substantially coincide with portions of geometric shape element perimeters 28 from various geometric shape elements 26. Additionally, image section 30 may comprise an image element 34 and an image section boundary 32. Image element 34 may have an image element perimeter 36. In at least one embodiment, a portion of image section boundary 32 may substantially coincide with a portion of image element perimeter 36.

In at least one embodiment, image section 30 and geometric shape section 22 may overlap each other at certain areas in camouflage pattern 20, and they may not overlap each other at various other areas in camouflage pattern 20. As shown in FIG. 5A, for example, a portion of image section boundary 32 may intersect a portion of geometric shape section boundary 24 at several points. A portion of geometric shape section 22 and a portion of image section 30 may overlap each other, the overlapping region being defined by an area between geometric shape section boundary 24 and image section boundary 32. Additionally, a separate portion of image section 30 may not overlap with geometric shape section 22. Rather, a portion of image section boundary 32 may substantially coincide with a portion of geometric shape section boundary 24, and a portion of image section 30 may be substantially adjacent to a portion of geometric shape section 22.

In additional embodiments, as shown in FIG. 5B, at least a portion of image section boundary 32 may substantially coincide with at least a portion of geometric shape section boundary 24, and at least a portion of image section 30 may be substantially adjacent to at least a portion of geometric shape section 22. Portions of geometric shape section boundary 24, and likewise, portions of image section boundary 32, may substantially coincide with portions of geometric shape element perimeters 28 of at least one geometric shape element 26. Additionally, portions of image section boundary 32, and likewise, portions of geometric shape section boundary 24, may substantially coincide with portions of image element perimeter 36 of image element 34.

Figure 6:
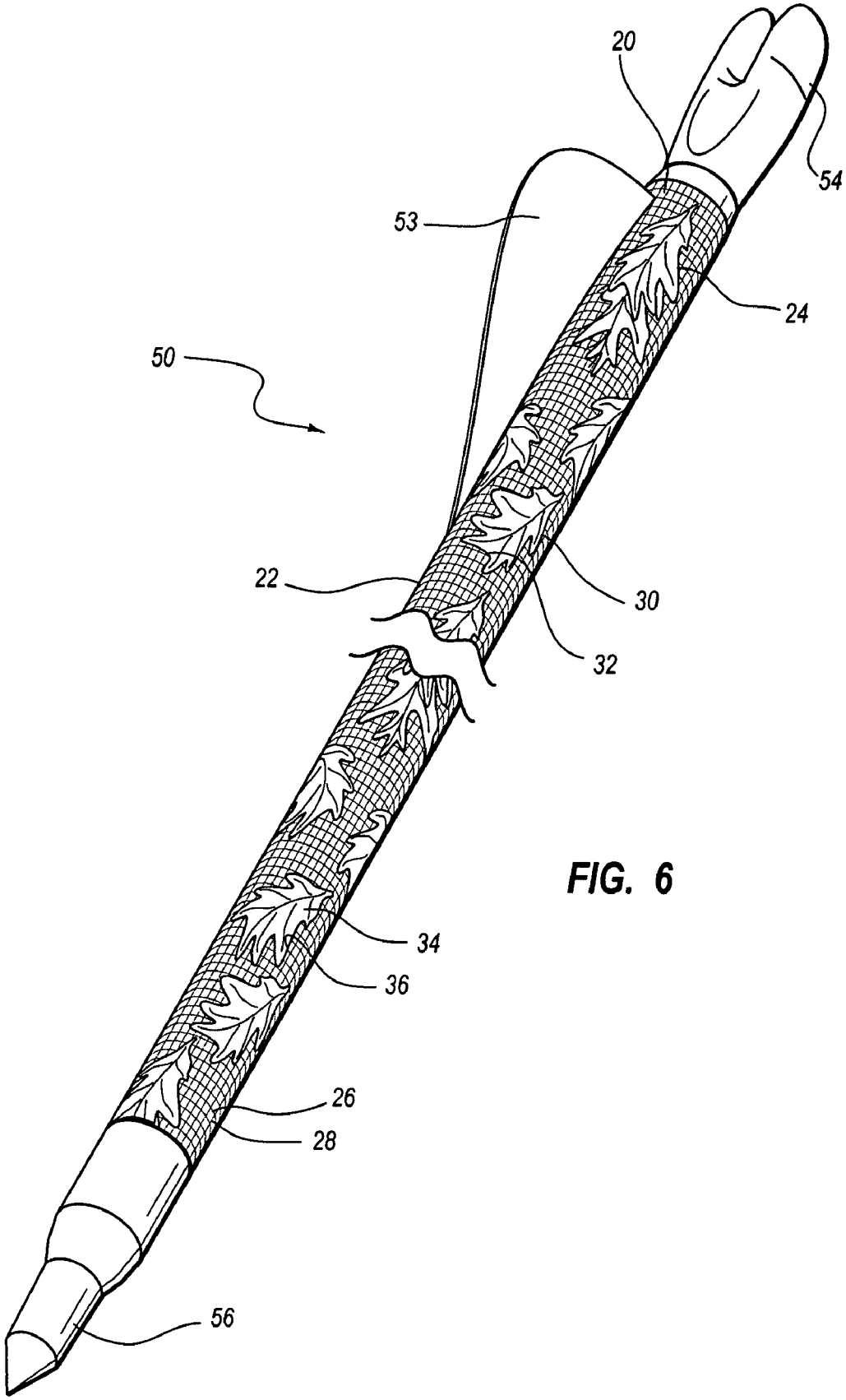
FIG. 6 is a perspective view of an exemplary archery arrow comprising a camouflage pattern according to at least one embodiment.

FIG. 6 illustrates an exemplary archery arrow 50 comprising a camouflage pattern 20. Although FIG. 6 shows an arrow shaft, the camouflage pattern may be used for any outdoor item, including without limitation clothing, blings, hunting accessories, and any other item. As illustrated in this figure, archery arrow 50 may comprise a nock 54, fletching 53, an arrow shaft 52, and a point 56. Camouflage pattern 20 may comprise a geometric shape section 22 and an image section 30. Geometric shape section 22 may comprise a plurality of geometric shape elements 26 and a geometric shape section boundary 24. Each of geometric shape elements 26 may have a geometric shape element perimeter 28. Image section 30 may comprise an image element 34 and an image section boundary 32. Image element 34 may comprise an image element perimeter 36.

Archery arrow 50 may comprise any type of arrow, including, for example, a hunting arrow or a target arrow. Archery arrow 50 may also comprise any type of crossbow arrow or crossbow bolt. Camouflage pattern 20 may also be placed on any portion of archery arrow 50, including, for example, arrow shaft 52, arrow fletching 53, nook 54, and/or point 56. In at least one embodiment, camouflage pattern 20 may be placed on an exterior surface of arrow shaft 52, as shown in FIG. 6. Camouflage pattern 20 may help visually conceal archery arrow 50. In various embodiments, a hunter may use archery arrow 50 to approach a game animal in an outdoor environment without being detected. Archery arrow 50, comprising both geometric shape section 22 and image section 30, may be obscured when viewed from a relatively close distance, a relatively far distance, and any intermediate distance. Archery arrow 50 may therefore be visually concealed relative to game animals.

Figure 7:
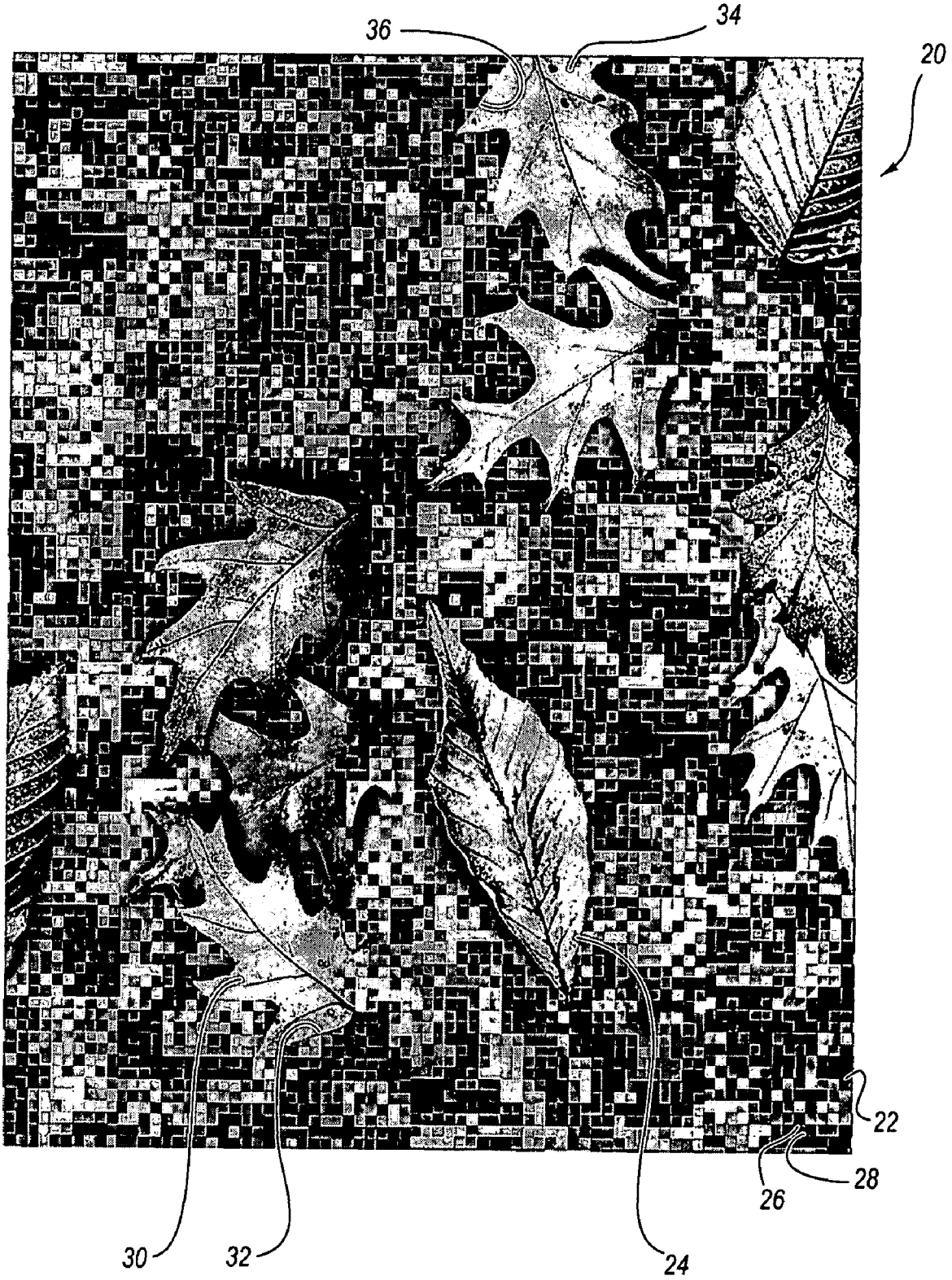
FIG. 7 is an illustration of an exemplary camouflage pattern according to an additional embodiment.

FIG. 7 illustrates an exemplary camouflage pattern 20. As illustrated in this figure, camouflage pattern 20 may comprise one or more geometric shape sections 22 and one or more image sections 30. Geometric shape section 22 may comprise a plurality of geometric shape elements 26 and a geometric shape section boundary 24. Each of geometric shape elements 26 may have a geometric shape element perimeter 28. Image section 30 may comprise an image element 34 and an image section boundary 32. Image element 34 may comprise an image element perimeter 36.

In at least one embodiment, as illustrated in FIG. 7, camouflage pattern 20 may comprise a plurality of image elements 34. In this embodiment, each of image elements 34 may comprise an image of a leaf from a natural forest scene. Additionally, various image elements 34 may comprise different images. Image elements 34 may comprise graphically realstic, or photo-realistic, images.

In certain embodiments, camouflage pattern 20 may also comprise a plurality of geometric shape elements in the form of pixels 26, which have square and/or rectangular shapes, as shown in FIG. 7. Pixels 26 may also comprise portions of square and/or rectangular shapes. For example, pixels 26 directly adjacent to portions of image elements 34 may comprise portions of square and/or rectangular shapes. Pixel section 22 and/or image section 30 may also comprise any suitable color or combinations of colors. In at least one embodiment, pixel section 22 and/or image section 30 may comprise multiple colors. Colors used in pixel section 22 and/or image section 30 may include colors having any suitable hue, lightness, and/or saturation. For example, the colors in pixel section 22 and/or image section 30 may include common colors and/or combinations of colors found in nature.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

What is claimed is:

1. A camouflage system, comprising:
an article having a surface;
a camouflage pattern, the camouflage pattern comprising:
a pixel shape section comprising:
a plurality of pixels;
a pixel section boundary;
an image section, the image section comprising:
an image element comprising a graphic image;
an image section boundary;
wherein the camouflage pattern covers a portion of the surface of the article.

2. An archery arrow system, comprising:
an archery arrow;
a camouflage pattern on a portion of the archery arrow, the camouflage pattern comprising:
a pixel section comprising:
a plurality of pixel elements;
a pixel section boundary;
an image section comprising:
an image element comprising a graphic image;
an image section boundary.

3. A camouflage system, comprising:
an article having a surface;
a camouflage pattern, the camouflage pattern comprising:
a geometric shape section comprising:
a plurality of geometric shape elements;
a geometric shape section boundary;
an image section, the image section comprising:
an image element comprising a graphic image;
an image section boundary;
wherein the camouflage pattern covers a portion of the surface of the article.

4. The system of claim 3, wherein the image element comprises a graphic image of a portion of a natural scene.

5. The system of claim 3, wherein the geometric shape section further comprises:
a first geometric shape element comprising a first color;
a second geometric shape element comprising a second color.

6. The system of claim 3, wherein the pixel section comprises a pixel comprising more than one color.

7. The system of claim 3, wherein the geometric shape section comprises a plurality of substantially congruent pixels.

8. The system of claim 3, wherein the pixel section comprises a plurality of substantially incongruent pixels.

9. The system of claim 3, wherein a portion of the pixel section boundary substantially coincides with a portion of the image section boundary.

10. The system of claim 3, wherein the pixel section comprises a pixel having a pixel perimeter;
wherein a portion of the pixel section boundary substantially coincides with a portion of the pixel perimeter.

11. The system of claim 3, wherein the pixel section comprises a pixel having a pixel perimeter;
wherein the image section boundary intersects the geometric shape element perimeter.

12. The system of claim 3, wherein the image element comprises an image element perimeter;
wherein a portion of the image section boundary substantially coincides with a portion of the image element perimeter.

13. The system of claim 3, wherein the image element comprises an image element perimeter;
wherein the pixel section boundary intersects the image element perimeter.

14. The system of claim 3, wherein the pixel section comprises a color substantially identical to a color in the image element.

15. The system of claim 3, wherein a portion of the pixel section and a portion of the image section occupy the same portion of the camouflage pattern.

16. The system of claim 3, wherein a portion of the image section overlaps a portion of the pixel section.

17. The system of claim 3, wherein a portion of the pixel section overlaps a portion of the image section.

18. The system of claim 3, wherein a portion of the pixel section and a portion of the image section overlap each other.

19. The system of claim 3, wherein the pixel section occupies a portion of the camouflage pattern that is distinct from the image section.

20. The system of claim 3, wherein the image of the portion of the natural scene comprises an image of a leaf.

* * * * *